US008876239B2

(12) United States Patent
Schippers

(10) Patent No.: US 8,876,239 B2
(45) Date of Patent: Nov. 4, 2014

(54) METHOD FOR CONTROLLING DROPLET EJECTION FROM AN INKJET PRINT HEAD

(71) Applicant: Oce-Technologies B.V., Venlo (NL)

(72) Inventor: Ronald H. Schippers, Venlo (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 14/035,616

(22) Filed: Sep. 24, 2013

(65) Prior Publication Data

US 2014/0022296 A1 Jan. 23, 2014

Related U.S. Application Data

(63) Continuation of application No. PCT/EP2012/054955, filed on Mar. 21, 2012.

(30) Foreign Application Priority Data

Apr. 8, 2011 (EP) ..... 11161616

(51) Int. Cl.
*B41J 2/07* (2006.01)
*B41J 2/21* (2006.01)

(52) U.S. Cl.
CPC . *B41J 2/07* (2013.01); *B41J 2/2135* (2013.01)
USPC ..... 347/14; 347/19; 347/78

(58) Field of Classification Search
CPC .. B41J 2/04505; B41J 2/04508; B41J 2/2135; B41J 29/38; B41J 2/07
USPC ..... 347/10–11, 14–15, 19, 43, 57
See application file for complete search history.

(56) References Cited

U.S. PATENT DOCUMENTS

| | | | | |
|---|---|---|---|---|
| 6,508,530 | B1 | 1/2003 | Conta et al. | |
| 6,984,011 | B2 * | 1/2006 | Shimada et al. | 347/19 |
| 7,625,057 | B2 * | 12/2009 | Koase | 347/14 |
| 2002/0030708 | A1 | 3/2002 | Yoshida | |
| 2004/0080555 | A1 | 4/2004 | Otsuki et al. | |

* cited by examiner

*Primary Examiner* — Thinh Nguyen
(74) *Attorney, Agent, or Firm* — Birch, Stewart, Kolasch & Birch, LLP

(57) ABSTRACT

A method for controlling droplet ejection, wherein droplets ejected from an inkjet print head are to be received on a recording substrate and wherein the print head and the recording substrate are moveable relative to each other, includes determining a set of droplet ejection moments, the set of droplet ejection moments determining when a droplet may be ejected from the print head; moving the inkjet print head and the recording substrate relative to each other; predicting an actual relative position of the print head and the recording substrate at a droplet ejection moment; and determining whether or not a droplet is to be ejected at the droplet ejection moment depending on the predicted actual relative position and depending on the predetermined pattern. Thus, droplets may be ejected from the print head only at stable droplet ejection moments resulting in an increased stability of operation of the print head.

20 Claims, 4 Drawing Sheets

METHOD FOR CONTROLLING DROPLET EJECTION FROM AN INKJET PRINT HEAD

CROSS REFERENCE TO RELATED APPLICATIONS

This application is a Bypass Continuation of PCT International Application No. PCT/EP2012/054955 filed on Mar. 21, 2012, which claims priority under 35 U.S. §119(a) to Patent Application No. 11161616.5 filed in Europe on Apr. 8, 2011, all of which are hereby expressly incorporated by reference into the present application.

FIELD OF THE INVENTION

The present invention generally pertains to inkjet printing and in particular to a method for controlling droplet ejection from an inkjet print head. The invention further provides a control unit for controlling an inkjet print head in accordance with the method and an inkjet printer comprising such a control unit.

BACKGROUND ART

A known inkjet print head comprises a number of actuators operatively coupled to a fluid chamber for generating a pressure wave in a fluid present in the fluid chamber. The pressure wave results in a droplet of the fluid being expelled through an orifice, which orifice—commonly also referred to as a nozzle—is in fluid communication with the fluid chamber.

In a known inkjet printer, the print head is arranged on a carriage and the carriage scans along a recording substrate. Thus, the print head is arranged to expel droplets and provide a swath of dots of a recording substance, such as a fluid ink or a fluid etch resist, on the recording substrate in accordance with a predetermined pattern. Such a pattern may be a graphical image such as a photo or the like or may represent a functional pattern such as a pattern of an electrical circuit to be formed on a printed circuit board (hereinafter also referred to as PCB). After printing the swath, the recording substrate is moved relative to the print head over such a distance that the print head is enabled to provide a subsequent swath in addition to the previous swath. The predetermined pattern may thus be formed by a suitable number of adjacent or overlapping swaths In another known inkjet printer, one or more inkjet print heads are fixedly arranged and the recording substrate moves relative to the one or more print heads, while the print heads expel droplets for forming the predetermined pattern in a single swath. In both above-described known inkjet printers, the print head and the recording substrate move relative to each other during printing, i.e. expelling of droplets, for forming the predetermined pattern. For forming the predetermined pattern, the droplets need to be positioned on the recording substrate accurately. If the resulting dots are not positioned accurately, the graphical image will show visible artifacts, which are undesirable. In case of a functional pattern, inaccurately positioned dots may lead to functional defects such as an interruption of an electrically conductive path, rendering the print result unusable. Consequently, it is at least desirable and in some instances even required that droplets are positioned accurately. At least one of the recording substrate and the print head moves during printing. For accurate positioning of dots it is needed that the movement is accurate, i.e. corresponds to an expected movement. In order to obtain an accurate movement, in a known printer, the movement is controlled to be uniform (constant velocity). However, it is virtually impossible or at least economically not feasible to actually obtain such a uniform movement in an inkjet printer. In practice, there are deviations from such uniform movement, for example due to manufacturing tolerances and the like. Therefore, it is known to determine the actual position of the moving part (recording substrate and/or print head) and use the determined actual position as a feedback signal in a control loop. In particular, the control loop is designed such that a deviation in the actual position as compared to an expected position is compensated by adapting the moment at which a droplet is expelled (hereinafter referred to as a droplet ejection moment). So, in the known printer, the control loop is designed to expel the droplet at such a moment that the dot will be positioned accurately.

In the known printer, however, droplet ejection is disturbed frequently, resulting in missing dots. It is evident that missing dots are at least undesirable and may even render the print result unusable, as above explained with respect to inaccurately positioned dots.

SUMMARY OF THE INVENTION

In a first aspect of the present invention, a method for controlling droplet ejection by an inkjet print head wherein droplets ejected from the inkjet print head are to be received on a recording substrate in accordance with a predetermined pattern, the inkjet print head and the recording substrate being moveable relative to each other is provided. The method according to the present invention comprises the steps of:

a) determining a set of droplet ejection moments, the set of droplet ejection moments determining when a droplet may be ejected from the inkjet print head;
b) moving the inkjet print head and the recording substrate relative to each other;
c) predicting an actual relative position of the inkjet print head and the recording substrate at a droplet ejection moment;
d) determining whether or not a droplet is to be ejected at the droplet ejection moment depending on the predicted actual relative position and depending on the predetermined pattern.

The method according to the present invention is based on the insight that after droplet ejection, the generated pressure wave damps and the fluid may return to a steady state. A subsequent droplet may be expelled once the fluid has returned to its steady state or after a certain predetermined period after a previous ejection. For example, at a moment when the pressure wave is such that the pressure in the fluid is (temporarily) equal to a pressure of the steady state or the pressure wave is such that the fluid is (temporarily) at rest, a subsequent droplet may be expelled. When a subsequent droplet may be expelled depends on the particular print head used, the fluid used and possibly other internal or external conditions. In any case, stable ejection of droplets is dependent on the moment of actuation for droplet ejection.

In the above described prior art, droplets may be ejected at moments deviating from the stable droplet ejection moments in order to position dots accurately. Ejecting at such moments deviating from the predetermined droplet ejection moments result in instability. In particular, it is known that droplet ejection at such instable droplet ejection moment may result in capturing an air bubble at the orifice, which air bubble may flow into the fluid chamber. An air bubble present in the fluid chamber changes the acoustics of the fluid chamber and as a result may disturb the pressure wave generation and ultimately the droplet formation process.

In the method according to the present invention, the actual droplet ejection moments are fixed to the stable droplet ejection moments as determined prior to printing, thereby excluding a droplet ejection at any other moment as such ejection would lead to instability as above explained. Usually, a fixed droplet ejection frequency is determined and thus an interval between separate droplet ejection moments is predetermined. Of course, in a particular embodiment, the droplet ejection frequency may be changed during printing, for example between printing of a first swath and a second swath. However, in general, such droplet ejection frequency may be ignored and a set of stable droplet ejection moments may be determined/selected prior to printing.

Then, the printing is started by moving the relevant part, i.e. the print head and/or the recording substrate. As soon as the movement is started, an actual position at a future droplet ejection moment may be predicted, for example based on the actual position at the particular moment of predicting and/or based on an accumulated deviation from an expected position and/or based on previous (deviation in) movements during previous print jobs. Also other prediction methods and combinations of prediction methods could be employed. In any case, the result of the step of predicting is that an actual position is predicted not based on theoretical and virtual conditions, but based on actual and real conditions. Preferably, such prediction is performed only shortly before the relevant stable droplet ejection moment occurs. For example, at the moment of a droplet ejection moment, a position prediction for a subsequent droplet ejection moment may be performed simultaneously. In general, the time period between position prediction and actual droplet ejection moment is preferably at short as possible, resulting in a position prediction that is as accurate as possible.

In order to improve the position prediction, previously gained information regarding the position may be employed as above-indicated. In an embodiment, the method according to the invention comprises determining a deviation from an intended relative position at a first droplet ejection moment and taking such deviation into account upon predicting an actual relative position at a later droplet ejection moment. In an embodiment, the method according to the invention comprises determining a deviation profile indicating a deviation from an intended relative position at a number of intended relative positions during a first relative movement of the inkjet print head and the recording substrate; and using the deviation profile for predicting an actual relative position during a later, similar relative movement of the inkjet print head and the recording substrate.

Having predicted a position for a certain droplet ejection moment, it is determined whether or not a droplet is actually to be ejected. Based on the predetermined pattern, it is determined whether or not a dot is to be provided on the recording substrate at the predicted position. Determining whether a droplet is to be ejected may further be based on a number of internal and external conditions. For example, in printing, a pattern to be printed may need half-toning and/or rasterizing, which may result in a dependency on whether or not a droplet is ejected at a previous droplet ejection moment, for example. Further, in particular in inkjet printing, flow behavior of the ink droplet on the recording substrate may be taken into account. In particular, the flow behavior may be dependent on the presence of a neighboring dot and, if such neighboring dot is present, whether or not the ink of that dot has dried. Further, such determining may take into account misdirecting nozzles, i.e. droplets are ejected at an angle and reach the recording substrate at an unexpected position, and/or take into account non-functioning nozzles, i.e. nozzles from which no droplets are ejected e.g. due to blockage of the nozzle.

Determining whether or not a droplet is to be expelled at a future droplet ejection moment takes a certain amount of time. Such an amount of time determines how long prior to the droplet ejection moment the prediction of the actual position needs to be performed. Hence, it is preferable to have a short processing time for the determining. In order to reduce the processing time, in an embodiment, for each droplet ejection moment a corresponding substrate position is determined and for each substrate position a determination whether or not to provide a dot is performed earlier. Then, only if the predicted actual relative position substantially deviates from the earlier determined substrate position, i.e. the deviation is larger than a predetermined threshold, the determination is performed anew.

In an embodiment, the substrate positions are determined taking into account the actual relative positions of the droplet ejection moments of a previous movement. In particular, in such embodiment, the method according to the invention comprises determining a deviation profile indicating a deviation from an intended relative position at a number of intended relative positions during a first relative movement of the inkjet print head and the recording substrate; and using the deviation profile for performing the determination of substrate positions for a later, second relative movement of the inkjet print head and the recording substrate, the second relative movement being in at least one aspect similar to the first relative movement, which first relative movement occurred prior to the second relative movement. For example, a print head movement for printing a first swath may be controlled to be a performed with a uniform constant speed. However, for example, due to imperfections in a guiding assembly, small deviations in the constant speed may occur. Recording such deviations, thereby providing a deviation profile, may be advantageous, since the same deviations in the constant speed may be expected when printing a second swath. Having such a deviation profile available prior to the actual movement for printing the second swath may be advantageously employed as the prediction of the actual relative positions during the printing of the second swath will be more accurate.

In an aspect of the invention, the invention further provides a control device for controlling an inkjet printer to perform the method according to the present invention and an inkjet printer provided with such a control device.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinafter and the accompanying schematical drawings which are given by way of illustration only, and thus are not limitative of the present invention, and wherein.

DETAILED DESCRIPTION OF THE DRAWINGS

Figure 1A:
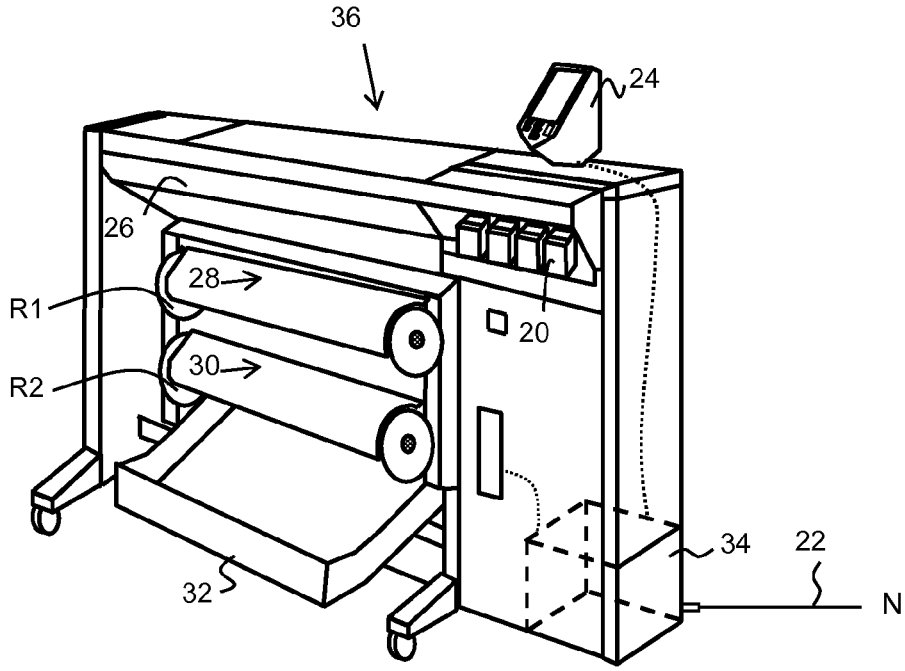
FIG. 1A shows a perspective view of a printing apparatus.

The present invention will now be described with reference to the accompanying drawings, wherein the same reference numerals have been used to identify the same or similar elements throughout the several views.

Figure 1B:
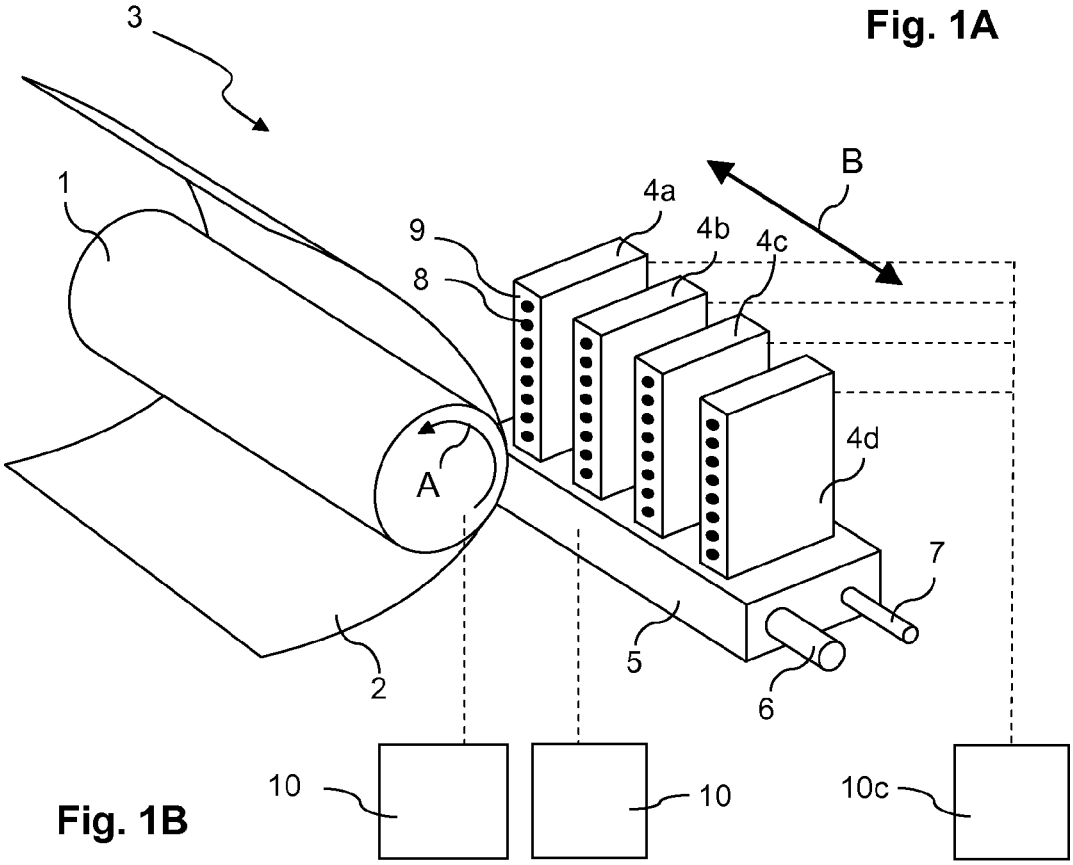
FIG. 1B shows a schematical perspective view of a scanning inkjet printing assembly.

FIG. 1A shows an image forming apparatus 36, wherein printing is achieved using a wide format inkjet printer. The wide-format image forming apparatus 36 comprises a housing 26, wherein the printing assembly, for example the ink jet printing assembly shown in FIG. 1B is placed. The image forming apparatus 36 also comprises a storage means for storing recording substrate 28, 30, a delivery station to collect the recording substrate 28, 30 after printing and storage means for marking material 20. In FIG. 1A, the delivery station is embodied as a delivery tray 32. Optionally, the delivery station may comprise processing means for processing the recording substrate 28, 30 after printing, e.g. a folder or a puncher. The wide-format image forming apparatus 36 furthermore comprises means for receiving print jobs and optionally means for manipulating print jobs. These means may include a user interface unit 24 and/or a control unit 34, for example a computer.

Images are printed on a recording substrate, for example paper, supplied by a roll 28, 30. The roll 28 is supported on the roll support R1, while the roll 30 is supported on the roll support R2. Alternatively, cut sheet recording substrates may be used instead of rolls 28, 30 of recording substrate. Printed sheets of the recording substrate, cut off from the roll 28, 30, are deposited in the delivery tray 32.

Each one of the marking materials for use in the printing assembly are stored in four containers 20 arranged in fluid connection with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 34 placed inside the printing apparatus 36. The control unit 34, for example a computer, comprises a processor adapted to issue commands to the print engine, for example for controlling the print process. The image forming apparatus 36 may optionally be connected to a network N. The connection to the network N is diagrammatically shown in the form of a cable 22, but nevertheless, the connection could be wireless. The image forming apparatus 36 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises supporting means for supporting a recording substrate 2. The supporting means are shown in FIG. 1B as a platen 1, but alternatively, the supporting means may be a flat surface, for example. The platen 1, as depicted in FIG. 1B, is a rotatable drum, which is rotatable about its axis as indicated by arrow A. The supporting means may be optionally provided with suction holes for holding the recording substrate in a fixed position with respect to the supporting means. The ink jet printing assembly 3 comprises print heads 4*a*-4*d*, mounted on a scanning print carriage 5. The scanning print carriage 5 is guided by suitable guiding means 6, 7 to move in reciprocation in the main scanning direction B. Each print head 4*a*-4*d* comprises an orifice surface 9, which orifice surface 9 is provided with at least one orifice 8 (also referred to as nozzle). The print heads 4*a*-4*d* are configured to eject droplets of marking material onto the recording substrate 2. The platen 1, the carriage 5 and the print heads 4*a*-4*d* are controlled by suitable controlling means 10*a*, 10*b* and 10*c*, respectively.

The recording substrate 2 may be a medium in web or in sheet form and may be composed of e.g. paper, cardboard, label stock, coated paper, plastic or textile. Alternatively, the recording substrate 2 may also be an intermediate member, endless or not. Examples of endless members, which may be moved cyclically, are a belt or a drum. The recording substrate 2 is moved in the sub-scanning direction A by the platen 1 along four print heads 4*a*-4*d* provided with a fluid marking material.

A scanning print carriage 5 carries the four print heads 4*a*-4*d* and may be moved in reciprocation in the main scanning direction B parallel to the platen 1, such as to enable scanning of the recording substrate 2 in the main scanning direction B. Only four print heads 4*a*-4*d* are depicted for demonstrating the invention. In practice an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guiding means 6, 7. These guiding means 6, 7 may be rods as depicted in FIG. 1B. The rods may be driven by suitable driving means (not shown). Alternatively, the carriage 5 may be guided by other guiding means, such as an arm being able to move the carriage 5. Another alternative is to move the image receiving material 2 in the main scanning direction B.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction A. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9, may negatively influence the ejection of droplets and the placement of these droplets on the recording substrate 2. Therefore, it may be advantageous to remove excess of ink from the orifice surface 9. The excess of ink may be removed for example by wiping with a wiper and/or by application of a suitable anti-wetting property of the surface, e.g. provided by a coating.

While FIG. 1A illustrates an image forming apparatus (printer) for providing a graphical image on a flexible recording substrate, the present invention may be employed in such apparatus, but may also be employed in a printing apparatus for providing a functional structure and/or for printing on a rigid substrate. For example, the printing apparatus may be configured to provide an etch resistant marking material on a rigid panel, which panel is provided with an electrically conductive layer. Then, after providing a suitable pattern on the panel, the electrically conductive layer may be etched such that an electrically conductive pattern is provided. Thus, a step in the manufacturing of a PCB may be provided.

Further, while FIG. 1B illustrates a scanning inkjet printing assembly, the present invention may as well be employed in a printing assembly in which the print head 4*a*-4*d* are fixedly arranged and the recording substrate 2 is moved relative to the fixedly arranged print head 4*a*-4*d* while the print head 4*a*-4*d* expels droplets for forming an image on the recording substrate 2.

Figure 2A:
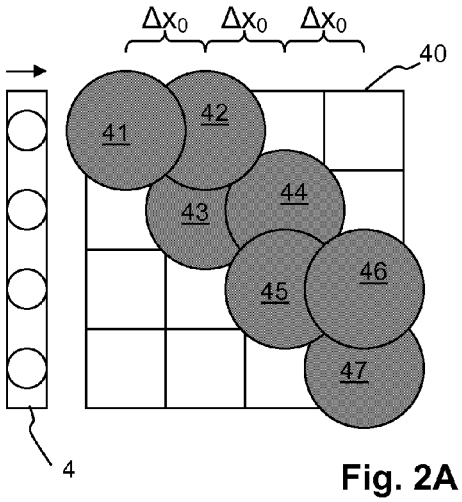
FIG. 2A-2B each schematically illustrate ink dot positioning on a predetermined grid in accordance with an embodiment of an inkjet printing process.
Figure 2B:
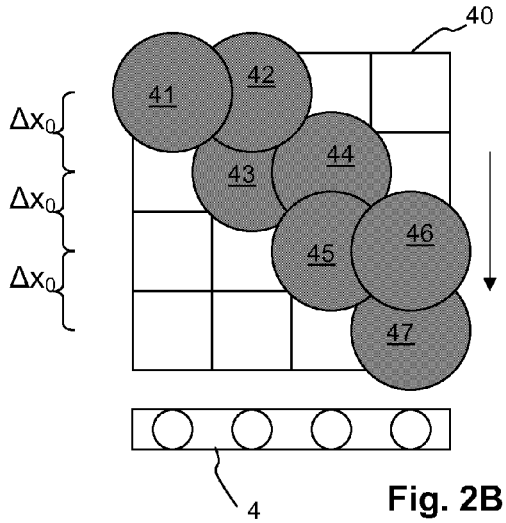

FIGS. 2A and 2B show a rectangular grid 40, which is in fact a virtual grid, i.e. in practice not visibly present, on which a number of dots 41-47 are provided. The dots 41-47 are arranged for forming a line. The line is arranged diagonally over the rectangular grid 40. The line is a mere example and the present invention is not limited to printing lines, but may be employed with any kind and form of image.

The dots 41-47 may be provided by use of a suitable printing process such as an inkjet process. For example, FIG. 2A illustrates a first embodiment of such a inkjet printing process for providing the dots 41-47. A print head 4 is moveably arranged such that the print head 4 may perform a scanning movement as indicated by arrow D relative to a recording substrate. During the scanning movement, droplets may be expelled at moments in time corresponding to a desired position of the resulting dot. As another example, FIG. 2B illustrates an inkjet printing process in which the print head 4 is fixedly arranged and the recording substrate moves relative to the print head 4 such that during movement of the recording substrate the print head 4 may expel droplet in accordance with predetermined positions of resulting dots. These embodiments of an inkjet printing process and the dot positioning using such inkjet printing process is discussed in more detail below in relation to FIG. 2C-2E.

With respect to the dots 41-47 as illustrated on the grid 40, due to the optimal positioning relative to the grid 40, the dots 41-47 partly overlap and do not leave any blank spaces between them. Thus, a completely filled line is provided. As indicated, the dots 41-47 are equidistantly spaced apart at a predetermined distance $\Delta x_0$. Provided that the dots 41-47 are indeed positioned optimally on the grid 40, an image having a good image quality is obtained on the recording substrate.

Figure 2C:
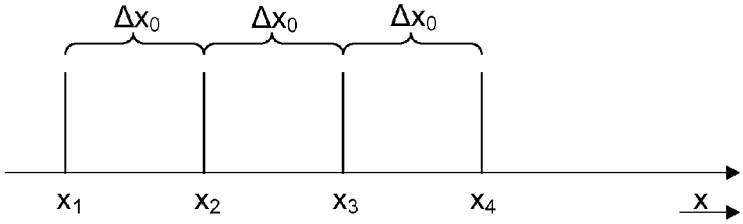
FIG. 2C shows a diagram illustrating dot positioning on the grid in accordance with FIGS. 2A and 2B.
Figure 2D:
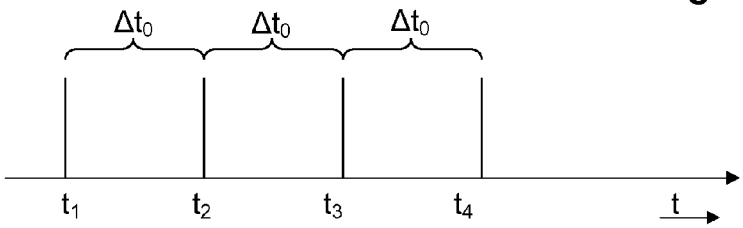
FIG. 2D-2E each show a diagram illustrating droplet ejection timing for the dot positioning illustrated in FIG. 2B.
Figure 2E:
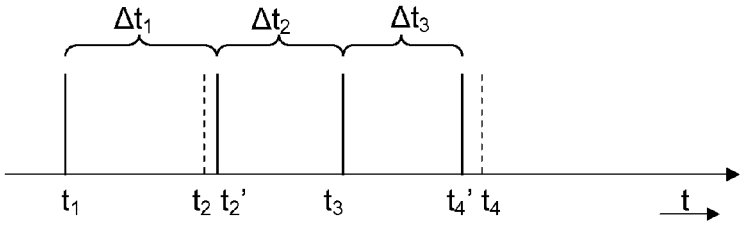

The positioning of the dots 41-47, as e.g. performed by the process illustrated in FIG. 1B, is illustrated by the diagram presented in FIG. 2C-2E. As illustrated by FIG. 2C having a horizontal axis representing position x, it is intended that the dots are arranged equidistantly at a mutual distance $\Delta x_0$. Hence, droplets may be provided at a first position $x_1$, a second position $x_2$, a third position $x_3$ and a fourth position $x_4$, considered in the direction of relative movement between the print head and the recording substrate. If the relative movement is performed with a constant velocity, the droplets may be expelled at moments in time at a constant interval $\Delta t_0$ as illustrated in FIG. 2D having a horizontal axis representing time t. Preferably, such interval corresponds to a preferred operating frequency of the print head, i.e. an operating frequency at which a minimum of instabilities of the droplet ejection operation occurs.

Although the velocity of the relative movement is usually controlled to be constant, in practice deviations occur. Therefore, in such common printing processes a feedback system is used to determine an actual position and droplets are ejected at the four positions $x_1$-$x_4$ based on the determined actual position, resulting in an irregular droplet frequency with unequal intervals $\Delta t_1$, $\Delta t_2$, $\Delta t_3$ between the separate droplet ejections as illustrated in FIG. 2E having a horizontal axis representing time t. Thus, the dots 41-47 (FIG. 2A-2B) are positioned as accurately as possible on the intended positions, resulting in a desired high image quality. However, such positioning results in an increased number of instabilities and consequently an increased number of missing dots or an increased number of required compensating droplet ejections.

Figure 3A:
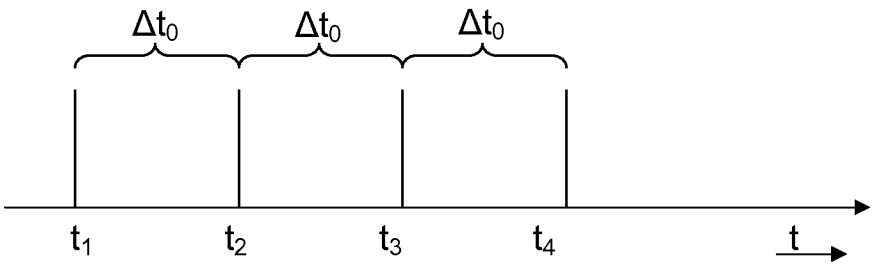
FIG. 3A shows a diagram illustrating droplet ejection timing for dot positioning in accordance with an embodiment of the present invention.
Figure 3B:
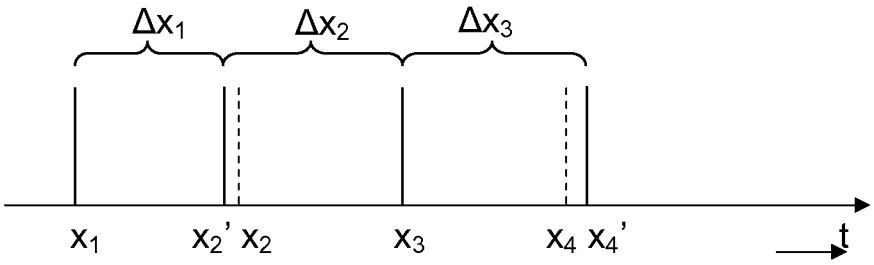
FIG. 3B shows a diagram illustrating dot positioning in accordance with the droplet ejection timing illustrated in FIG. 3A.
Figure 3C:
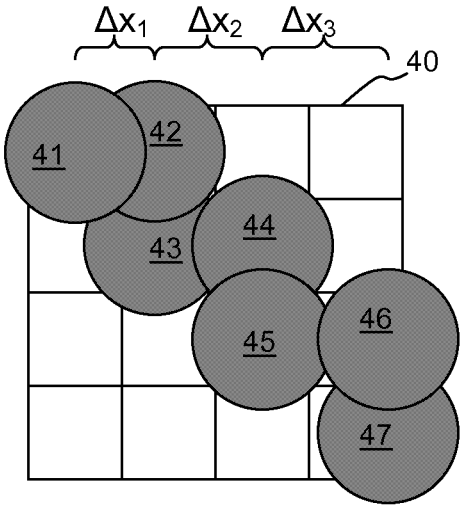
FIG. 3C schematically illustrates ink dots positioned in accordance with the present invention forming a line.

While the high image quality may be desired for certain applications, in other applications, such as but not limited to functional printing applications, stable droplet ejection may be preferred over a high image quality. Thereto, the present invention provides a method as illustrated in FIG. 3A-3C. FIG. 3A is similar to FIG. 2D and shows an optimal droplet ejection timing at equal intervals $\Delta t_0$ at a preferred droplet ejection frequency. In the method according to the present invention, the droplet ejection frequency is maintained during actual operation. FIG. 3B illustrates a consequence of such maintaining of the droplet ejection frequency: droplets may be positioned at a position deviating from a desired position. For example, instead of being positioned at position $x_2$, a droplet may be positioned at position $x_2'$; and instead of being positioned at position $x_4$, a droplet may be positioned at position $x_4'$. These deviating positions $x_2'$,$x_3$, $x_4'$ are used in FIG. 3C to illustrate the resulting dot formation.

As shown in FIG. 3C, the dots 42-43 are shifted towards the dot 41, thereby having a larger overlap therewith, but still also overlapping with the dot 44 and thus still providing a closed line, which could be essential for the resulting functional structure. The dots 46-47 are shifted away from the dot 45, thereby decreasing an overlap area, but still providing a closed line. Hence, while the image quality may have deteriorated (note that in practice such image quality deterioration may not even be visible with the human eye), the functionality of the resulting image may be maintained. Having increased the reliability of the printing process, the method according to the present invention may be advantageously used in functional image printing, but may also be advantageously used in graphical image printing.

In FIG. 3A-3C, the position deviations are illustrated to be relatively small. That means that ejecting droplets at the intended timing does not result in large deviations. However, in practice, large deviations could occur. Therefore, the method according to the present invention includes the step of predicting an actual relative position of the inkjet print head and the recording substrate at a droplet ejection moment in order to prevent such (too) large position deviations. Thus, prior to ejecting a droplet it is predicted where a droplet will be positioned and, if the resulting actual position may deviate less from the intended position, another stable droplet ejection moment may be selected for positioning the corresponding dot. For example, if the predicted dot position deviates more than $\frac{1}{2}\Delta x_0$ from an intended position, it may be determined that the prior or subsequent stable droplet ejection moment may result in less position deviation and thus may be advantageously selected for ejecting the droplet. This method step, included but not explicitly illustrated in FIG. 3A-3C, is illustrated in and is described in relation to FIG. 4A-4B in more detail.

Figure 4A:
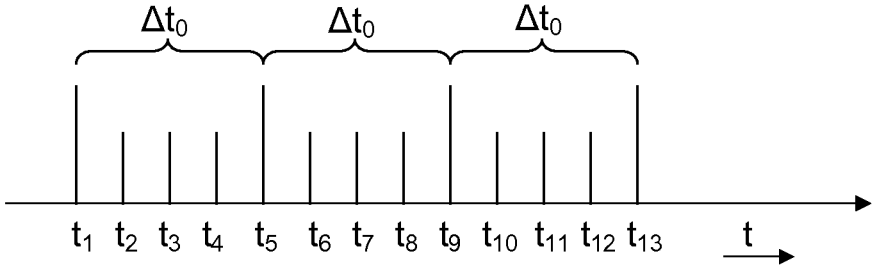
FIG. 4A-4B show a diagram illustrating droplet ejection timing for dot positioning in accordance with an embodiment of the present invention.
Figure 4B:
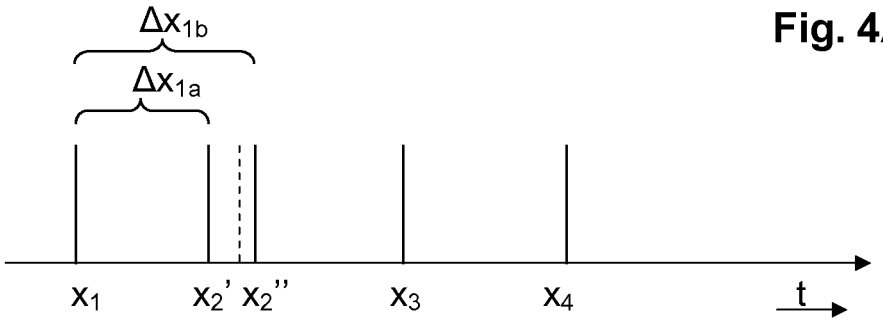

FIGS. 4A and 4B illustrate an embodiment of the present invention, in which a predetermined droplet ejection frequency is lower than a stable droplet ejection operation frequency of the print head. In particular, dots may be provided at an interval $\Delta t_0$ to provide dots at predetermined desired positions. The print head may have a stable droplet ejection frequency having corresponding stable droplet ejection moments $t_1$-$t_{13}$. So, there are more stable droplet ejection moments available than required for positioning droplets at the desired dot positions.

Referring to FIG. 4A, if the actual dot position deviates substantially from the intended position at time $t_5$, for example, the method may comprise the step of determining an actual position if the droplet would be ejected at a prior stable ejection moment $t_4$ or a subsequent stable ejection moment $t_6$, for example. If such prior or subsequent stable ejection moment would result in an actual position less deviating from the desired position compared to the actual position corresponding to the originally intended droplet ejection moment $t_5$, the actual droplet ejection moment may be selected based on a minimum deviation of the resulting dot position.

More in particular, with reference to FIG. 4B, it is presumed that droplet ejection at time $t_5$ would result in a dot being positioned at position $x_2'$ corresponding to a spacing $\Delta x_{1a}$ relative to an adjacent dot. Further, it is presumed that droplet ejection at time $t_6$ would result in a dot being positioned at position $x_2''$ corresponding to a spacing $\Delta x_{1b}$ relative to the adjacent dot. Both positions deviate from the intended position, which is indicated by a dashed line. From FIG. 4B it is apparent that the resulting position $x_2''$ is closer to the intended position and the spacing $\Delta x_{1b}$ approaches the desired spacing $\Delta x_0$. Consequently, in accordance with the present invention, the droplet ejection moment $t_6$ may be selected for ejecting the droplet.

Based on the above described considerations, multiple other embodiments are contemplated. For example, if the print head is enabled and configured to eject droplets of different droplet size, the method may include the step of determining which droplet size may be used at each stable droplet ejection moment. In particular, a single large droplet may be ejected in order to position a large dot at a first position. However, if the timing is such that the large droplet would be positioned incorrectly, it may be determined to position two small dots, one on either side of the first position, for example.

As a further example of another embodiment, if a deviation from an expected position has been determined for a first stable droplet ejection moment, the determined deviation may be taken into account when predicting an expected position for a later stable ejection moment. Such prediction may be related to a position for a same printing job and/or a same print head scanning movement, but may also be used for detecting and determining expected positions for stable ejection moments for a subsequent or even later print job. Thus, the accuracy of the expected positions compared to the actual positions may increase over time, thereby reducing required computational power in operation for compensating deviations from expected positions.

In an embodiment, required computational power may also be reduced by employing a threshold for a position deviation. If a deviation of an actual position on a stable droplet ejection moment from the expected position is smaller than the threshold, a droplet may be expelled if there were no deviation, but if the deviation exceeds the threshold, a determination whether or not to eject the droplet may be performed again. Thus, in case of small deviations, no computational power is needed for performing a determination whether or not to expel a droplet.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. Method for controlling droplet ejection by an inkjet print head, wherein droplets ejected from the inkjet print head are to be received on a recording substrate in accordance with a predetermined pattern, the inkjet print head and the recording substrate being moveable relative to each other, the method comprising:

a) determining a set of stable droplet ejection moments, the set of stable droplet ejection moments determining when a droplet may be stably ejected from the inkjet print head;

b) moving the inkjet print head and the recording substrate relative to each other;

c) predicting an actual relative position of the inkjet print head and the recording substrate at a stable droplet ejection moment;

d) determining whether or not a droplet is to be ejected at the stable droplet ejection moment depending on the predicted actual relative position and depending on the predetermined pattern.

2. Method according to claim 1, wherein in step b) the inkjet print head is moved relative to the recording substrate for positioning droplets on the recording substrate in accordance with the predetermined pattern.

3. Control device for controlling an inkjet print head in accordance with the method according to claim 2.

4. Method according to claim 1, wherein in step b) the recording substrate is moved relative to the inkjet print head for positioning droplets on the recording substrate in accordance with the predetermined pattern.

5. Control device for controlling an inkjet print head in accordance with the method according to claim 4.

6. Method according to claim 1, wherein the inkjet print head is configured to be able to eject a droplet of a first size and a droplet of a second size and wherein step d) comprises, if it is determined that a droplet is to be ejected, further determining whether a droplet of the first size or a droplet of the second size is to be ejected.

7. Control device for controlling an inkjet print head in accordance with the method according to claim 6.

8. Method according to claim 1, wherein step c) comprises determining a deviation from an intended relative position at a first droplet ejection moment and taking such deviation into account upon predicting an actual relative position at a later droplet ejection moment.

9. Control device for controlling an inkjet print head in accordance with the method according to claim 8.

10. Method according to claim 1, wherein step c) comprises determining a deviation profile indicating a deviation from an intended relative position at a number of intended relative positions during a first relative movement of the inkjet print head and the recording substrate; and using the deviation profile for predicting an actual relative position during a second relative movement of the inkjet print head and the recording substrate, the second relative movement being in at least one aspect similar to the first relative movement, which first relative movement occurred prior to the second relative movement.

11. Control device for controlling an inkjet print head in accordance with the method according to claim 10.

12. Method according to claim 1, wherein step a) comprises a1) determining a set of substrate positions corresponding to the set of droplet ejection moments, a2) determining for each substrate position whether or not a droplet is to be provided, and wherein step d) comprises d1) determining for each predicted actual relative position a deviation from the substrate position determined in step a1), and d2) based on the deviation determined in step d1), determining whether or not a droplet is to be ejected at the corresponding droplet ejection moment.

13. Method according to claim 12, wherein in step d2) the determined deviation is compared to a predetermined threshold and wherein step d2) comprises if the determined deviation is smaller than the threshold, using the result of the determination of step a2) to determine whether or not to eject a droplet;

if the determined deviation exceeds the threshold, performing step a2) based on the predicted actual relative position in order to determine whether or not to eject a droplet.

14. Control device for controlling an inkjet print head in accordance with the method according to claim 13.

15. Method according to claim 12, wherein step c) comprises determining a deviation profile indicating a deviation from an intended relative position at a number of intended relative positions during a first relative movement of the inkjet print head and the recording substrate; and using the deviation profile for performing step a1) for a later relative movement of the inkjet print head and the recording substrate.

16. Control device for controlling an inkjet print head in accordance with the method according to claim 15.

17. Control device for controlling an inkjet print head in accordance with the method according to claim 12.

18. Control device for controlling an inkjet print head in accordance with the method according to claim 1.

19. Method according to claim 1, wherein the set of stable droplet ejection moments includes more droplet ejection moments than actually required for positioning droplets at desired positions on the recording substrate in accordance with the predetermined pattern.

20. Inkjet printing assembly comprising a control device and an inkjet print head, the inkjet printing assembly being configured to perform a method for controlling droplet ejection by the inkjet print head, wherein droplets ejected from the inkjet print head are to be received on a recording substrate in accordance with a predetermined pattern, the inkjet print head and the recording substrate being moveable relative to each other, the method comprising:

a) determining a set of stable droplet ejection moments, the set of stable droplet ejection moments determining when a droplet may be stably ejected from the inkjet print head;

b) moving the inkjet print head and the recording substrate relative to each other;

c) predicting an actual relative position of the inkjet print head and the recording substrate at a stable droplet ejection moment;

d) determining whether or not a droplet is to be ejected at the stable droplet ejection moment depending on the predicted actual relative position and depending on the predetermined pattern.

* * * * *